United States Patent [19]

Melton, Jr. et al.

[11] 3,974,939

[45] Aug. 17, 1976

[54] SYSTEM FOR INJECTING PARTICULATE MATERIAL INTO THE COMBUSTION CHAMBER OF A REPETITIVE COMBUSTION COATING APPARATUS

[75] Inventors: Rosser B. Melton, Jr., Helotes; Elbert M. Hubbard, Dallas, both of Tex.

[73] Assignee: Southwest Research Institute, San Antonio, Tex.

[22] Filed: Nov. 4, 1974

[21] Appl. No.: 520,671

Related U.S. Application Data

[62] Division of Ser. No. 458,884, April, 1974, Pat. No. 3,893,578.

[52] U.S. Cl. ..... 222/1; 222/325; 222/541; 214/305

[51] Int. Cl.[2] ..... B65D 47/10

[58] Field of Search ..... 222/1, 80, 194, 193, 222/325, 541; 46/194, 195; 214/152, 305

[56] References Cited

UNITED STATES PATENTS

| | | | |
|---|---|---|---|
| 1,406,904 | 2/1922 | Rose | 222/325 X |
| 1,811,572 | 6/1931 | Ailes | 222/325 X |
| 2,116,716 | 5/1938 | Rose | 222/325 X |
| 2,637,941 | 5/1953 | Langos | 46/195 |
| 2,639,543 | 5/1953 | Abler | 46/195 X |
| 3,116,450 | 12/1963 | Longwill | 222/541 X |
| 3,421,662 | 1/1969 | Hanson | 222/541 X |

*Primary Examiner*—Allen N. Knowles
*Assistant Examiner*—F. Hodd Lane
*Attorney, Agent, or Firm*—Hubbard, Thurman, Turner & Tucker

[57] ABSTRACT

A repetitive combustion system for coating a work piece with particulate material is disclosed which utilizes an encapsulating tape having a plurality of discrete capsules each containing a predetermined quantity of the particulate coating material. The capsules are sequentially fed into a stripping chamber where the tape is clamped between inlet and outlet manifolds which provide a circumferential seal around the respective capsules so that pressure can be applied to an inlet face of the capsule. The inlet face is so configured as to admit air into the interior of the capsule which then swells and bursts the outlet face or otherwise passes through the outlet faces. The air pressure then injects the particulate material into the combustion chamber while the pressure in the combustion chamber is near the peak produced by combustion. A number of different tape configurations are disclosed and also a number of different stripping stations designed to enhance scavenging of all of the particulate material from the capsules without entraining any of the material forming the capsules and to position the capsules to the station at a high rate. The coating apparatus includes a sequencing means which feeds the tape at a continuous rate through the stripping station and initiates introduction of a fuel-air mixture to the combustion chamber, ignition of the fuelair mixture, and injection of the particulate material from the stripping station in the proper sequence. High speed rotary manifold systems for positioning these capsules at the stripping station are also disclosed.

4 Claims, 29 Drawing Figures

SYSTEM FOR INJECTING PARTICULATE MATERIAL INTO THE COMBUSTION CHAMBER OF A REPETITIVE COMBUSTION COATING APPARATUS

This is a division of application Ser. No. 458,884, filed Apr. 8, 1974, now U.S. Pat. No. 3,893,578 of July 8, 1975.

The present invention relates generally to systems for coating work pieces with particulate material, and more particularly relates to an improved system for commercially distributing the particulate material from the manufacturer, storing the particulate material in a protected environment, handling the particulate material prior to its use in a coating apparatus, and injecting a controlled quantity of the particulate material at a precisely controlled instant and location in the combustion chamber of a repetitive pulse coating apparatus to produce a coating of improved quality.

Co-pending application Ser. No. 198,806, entitled "Method and Apparatus for Applying Particulate Coating Material to a Piece of Work", filed on Nov. 15, 1971 on behalf of Melton, et al, and assigned to the assignee of the present invention, and U.S. Pat. No. 2,972,500, disclose systems for applying particulate coating material, such as tungsden carbide, to a work piece in a series of pulses.

The system disclosed in the former utilizes a combustible fuel-air mixture which is introduced to a combustion chamber having a restricted outlet nozzle at a sufficient rate to increase the pressure substantially above atmospheric pressure. The inlet valve is then closed and the mixture ignited while the pressure is still at a high level. The resulting combustion produces a still higher pressure as a result of confinement by the restricted outlet nozzle, and the hot gases of combustion then exit through the restricted outlet nozzle at a high velocity during a blow-down period. Particulate material is injected into the combustion chamber, preferably near the end of combustion, and before the peak pressure has been materially reduced. As a result, the particulate material is both heated and propelled from the nozzle against the work piece at a high velocity where the particulate material flattens and adheres to the work piece to form the coating.

The system disclosed in U.S. Pat. No. 2,972,550 utilizes somewhat the same technique, except that a detonatable mixture must be used in a long, open-ended tubular combustion chamber designed to sustain a detonation wave. The detonation wave results in a substantially instantaneous pressure rise within the chamber as a result of the very rapid combustion. Again, the hot gases heat the particles, which must be injected just prior to detonation, and the high pressure causes the gases to rush from the open end of the tube thus propelling the particles at high velocity against the work piece.

In each of these systems, the repetitive rate of the combustion pulses is relatively high, on the order of ten per second, for example. Both the coating efficiency, i.e., the per cent of particles which adhere to the work piece, and the quantity of the coat are highly dependent upon injecting the particles into the combustion chamber in uniformly repetitive quantities at precisely the right instant. One of the principal difficulties with each of the previous systems resided in the particle injection systems employed. Each system has utilized a bulk hopper for the particulate material and some type of mechanical-pneumatic dispensing system for measuring and injecting the very small quantity of particulate material required for each "shot". Bulk handling of the particulate material results in undersidable segregation of large particles from small particles. Such systems are also generally unreliable because the particulate material tends to cake and feed unevenly from the bulk hopper. Further, the high speed pneumatic transport of the highly abrasive particulate material results in extremely rapid abrasion of the penumatic valving and conduits which often fail. Further, many particulate materials are subject to oxidation and other adverse effects as a result of being subjected to humidity of the atmosphere, and protection from oxidation is very difficult during bulk handling of these materials at the coating site.

U.S. Pat. NO. 3,461,268 discloses a system wherein particulate material is encapsulated in pockets of a tape and positioned at the outlet end of a high voltage spark chamber. The spark in the chamber results in an explosion which propells both the heated particles and the material forming the package against the work piece to form a coating. While such a spark system may be suitable for some types of coating, the entrainment of the material forming the encapsulating tape materially and adversely affects the quality of the type of coatings of interest in the present application.

The present invention is concerned with improved encapsulating tapes, improved particulate powder injection stations adapted to use the improved encapsulating tape, coating systems having an improved control system which is responsive to the position of the encapsulating tape, and methods relating thereto.

The system of the present inventiion utilizes a method which comprises encapsulating the particulate material in an enclosure having inlet and outlet faces, injecting air pressure through the inlet face into the interior of the capsule to expand the capsule and burst the outlet face, and directing the entrained particulate material into co-mingling relationship with hot gases which eat and accelerate the particulate material against a work piece.

In accordance with another aspect of the invention, the encapsulating tape is formed of two film strips, one of which is configured in such a manner as to facilitate the passage of pneumatic pressure into the interior of the capsule so that the outlet face can be burst by the pneumatic pressure. Preferential pneumatic penetration points, either openings or weakened areas, in the inlet face can be formed on the tape during manufacture or can be initiated mechanically at the stripping station.

In accordance with another aspect of the invention, the stripping station and tape are configured in such a manner as to facilitate selective penetration of the inlet face of the capsule by the air pressure and bursting of a preselected area of the outlet face so as to establish a turbulent flow path within the capsule by the air to encourage complete scavenging of the particulate material from the capsule.

The invention further contemplates a control system wherein the encapsulating tape is pulled past the stripping station with a continuous uniform force. The position of a capsule as it approaches the stripping station is sensed and a combustion cycle initiated in response to the capsule arriving at the predetermined point. The tape is momentarily clamped at the stripping station while the particulate material is pneumatically stripped from the interior of the capsule and injected into the combustion chamber.

The invention also contemplates a rotary system for stationing the capsules of the encapsulating tape at the stripping station to permit high repetition rates of the combustion cycle. and special tape configuration suitable for use with such systems.

The novel features believed characteristic of this invention are set forth in the appended claims. The invention itself, however, as well as other objects and advantages thereof, may best be understood by reference to the following detailed description of illustrative embodiments, when read in conjunction with the accompanying drawings, wherein:

Figure 1:
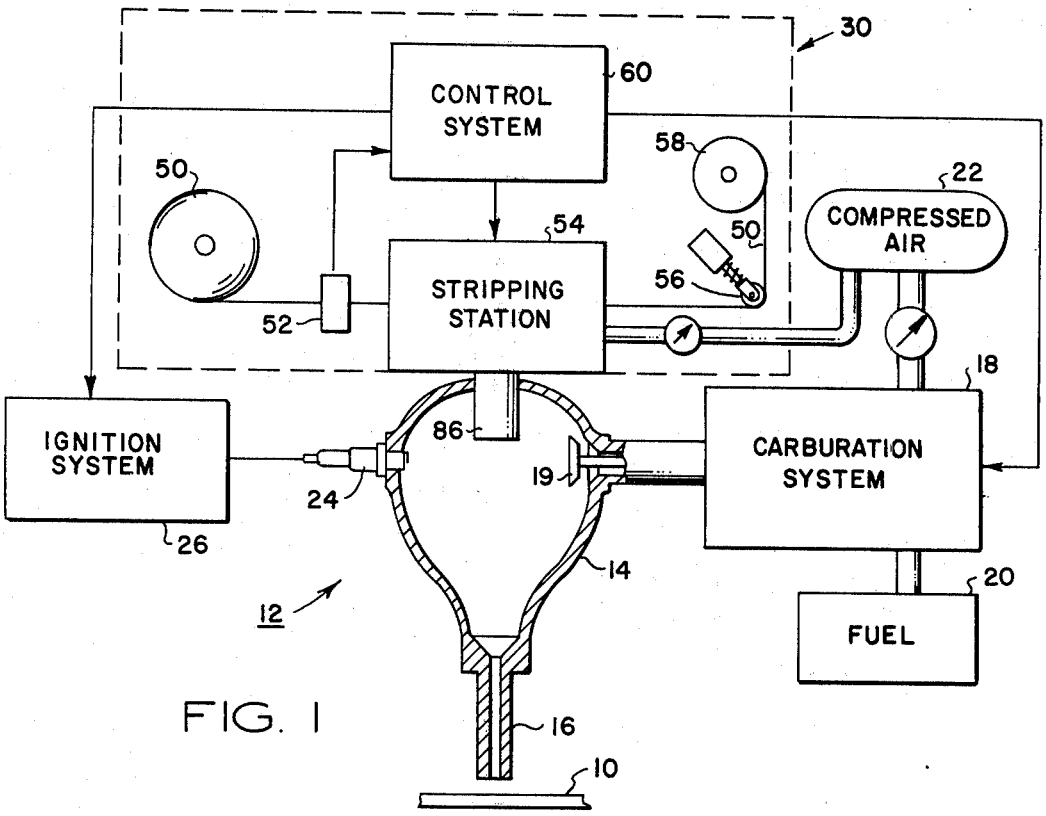
FIG. 1 is a schematic block diagram of a system for coating a work piece with particulate material which utilizes the present invention.

Referring now to the drawings, a system for coating particulate material on a work piece 10 is indicated generally by the reference numeral 12 in FIG. 1. The system 12 includes a combustion chamber 14 having a restricted outlet nozzle 16. A combustible fuel-air mixture is formed by means of a carburator 18 which mixes fuel from a source 20 with compressed air from a source 22. The fuel-air mixture is fed into the combustion chamber through an inlet valve 18 and is ignited by the spark plug 24 of an ignition system 26.

A particulate material injector system indicated generally by the reference numeral 30 injects measured quantities of particulate material into the combustion chamber 14. The injector system 30 includes a reel of encapsulating tape 50 which is fed through a capsule sensor 52 past a stripping station 54 and over a tensioning idler roller 56 to a take-up reel 58. A control circuit 60 responds to a signal from the sensor 52 and initiates the proper sequence of operation for each combustion cycle as will hereafter be described in greater detail.

Figure 4:
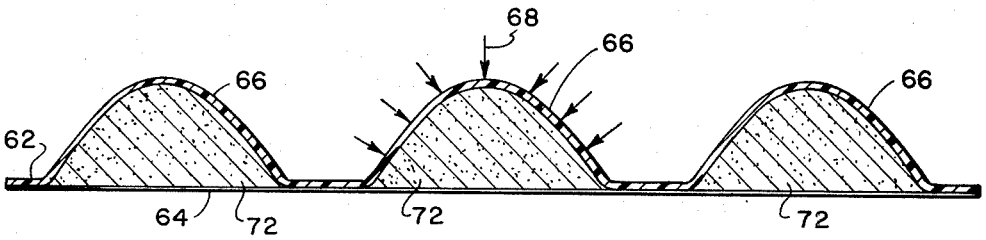
FIG. 4 is a sectional view taken substantially along lines 4—4 of FIG. 3.
Figure 5:
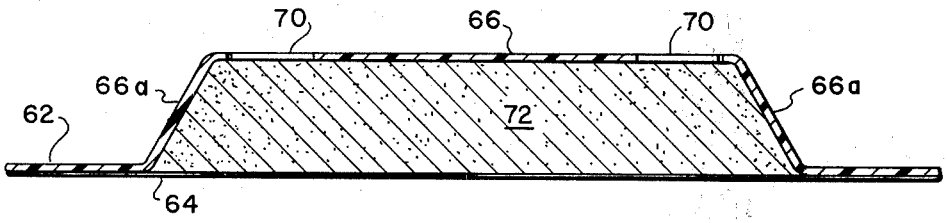
FIG. 5 is a sectional view taken substantially along lines 5—5 of FIG. 3.
Figure 6:
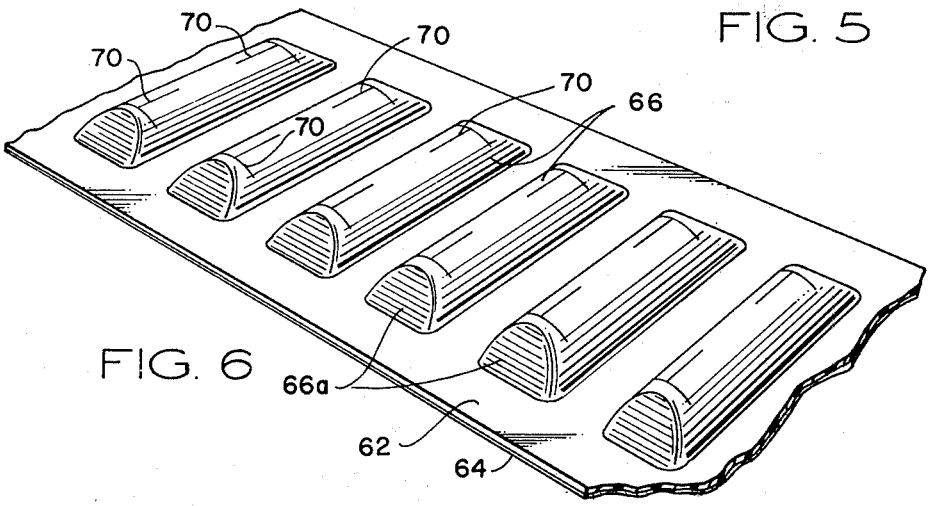
FIG. 6 is a perspective view of the encapsulating tape of FIG. 3.

The encapsulating tape 50 is shown in greateer detail in FIGS. 3–6, and includes a relatively thick plastic film strip 62 and a relatively thin plastic film strip 64. Each of the film strips may conveniently be polyethylene or a similar plastic material preferably of the type which can be heat welded. The relatively thick film strip 62 is embossed with a series of elongated pockets 66 extending transversely of the tape. Each of the pockets has an arcuate cross-section as illustrated in FIG. 4 with generally flattened ends **66*a* as can best be seen in FIGS. 5–6. The effect of the arcuate cross-section and flattened ends of the pockets 66 is to provide a structure which is resistant to crushing under a pressure load applied in a direction indicated by the arrows 68 in FIG. 4 when the flat portion of the tape 62 is clamped between inlet and outlet manifolds as will presently be described. A pair of T-cuts 70 in each end of each of the pockets 66 extend completely through the film strip 62 and form a pair of flaps which can open when subjected to the air pressure represented by the arrows 68, but which are normally resistant to movement in the opposite direction by the curvature of the arcuate portions of the pockets so as to retain the particulate material. The relatively thin film strip 64 is sealed to the relatively thick film strip 62** by a thermal weld extending around the entire periphery of each of the pockets rated by high pressure applied to the surface of the dome before the dome collapses.

Figure 13:
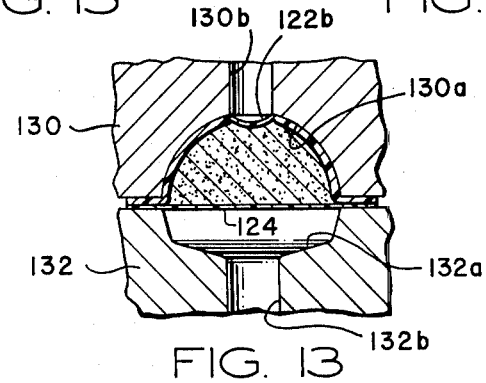
FIG. 13 is a sectional view of another stripping station in accordance with the present invention for the encapsulating tape of FIG. 11.

The encapsulating tape 120 may be used in a stripping station, such as station 54, having input and output manifolds 130 and 132, respectively, configured as illustrated in FIG. 13. The manifolds have circular cavities 130*a* and 132*a*, respectively, and inlet and outlet orifices 130*b* and 132*b*, respectively. When high pressure is applied through inlet orifice 130*b*, the high pressure penetrates the thin dimpled section 122*b* so that the pressure enters the interior of the capsule, expanding the lower film 124 downwardly until it bursts over the outlet orifice 132*b*.

Figure 14:
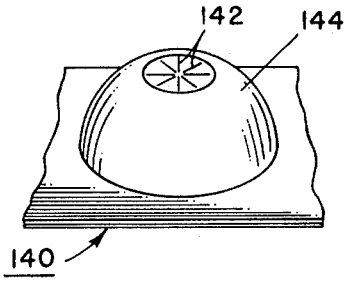
FIG. 14 is a perspective view of still another encapsulating tape in accordance with the present invention.

Another encapsulating tape in accordance with the present invention is indicated generally by the reference numeral 140 in FIG. 14. The encapsulating tape 140 may be identical to the encapsulating tape 120 except that the top of the dome is provided with a series of line cuts 142 to facilitate entry of the high pressure air into the interior of the capsule before the dome 144 collapses. The pie shaped flaps formed by the line cuts 142 function somewhat as a checkvalve to hold the particulate material inside the dome, yet admit air pressure from outside the dome.

Figure 15:
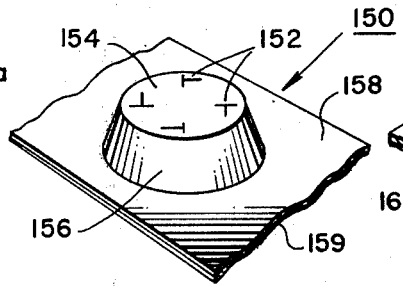
FIG. 15 is a perspective view of yet another encapsulating tape in accordance with the present invention.

Still another encapsulating tape in accordance with the present invention is indicated generally by the reference numeral 150 in FIG. 15. Encapsulating tape 150 has a series of T-cuts 152 disposed around the periphery of a generally flat surface 154 of a dome 156 impressed in a relatively thick film strip 158. Particulate material is encapsulated inside the dome 156 by a relatively thin film strip 159. The encapsulating tape 150 may also be used in a stripping station having manifolds similar to that illustrated in FIG. 13.

It will be noted that the T-cuts 152 are arranged so that when subjected to high pressure above the dome, the flaps formed by the T-cuts tends to divert the air tangentially around the interior of the dome, thereby imparting a swirling motion to the air to facilitate complete scavenging of the particulate material from the interior of the dome. Further, the swirling motion of the air imparts a swirling motion to the particles as they pass through the outlet orifice 132*b*. The swirling trajectory of the particles cause the particles to be sprayed outwardly within the combustion chamber to increase retention time in the combustion chamber, and thus heating.

Figure 16:
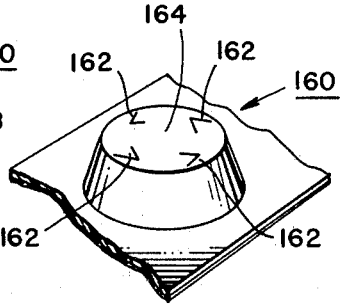
FIG. 16 is a perspective view showing still another encapsulating tape in accordance with the present invention.

Still another encapsulating tape in accordance with the present invention is indicated generally by the reference numeral 160 in FIG. 16. The encapsulating tape 160 is similar to the encapsulating tape 150, except that V-shaped cuts 162 are made around the periphery of the flat surface 164 rather than the T-shaped cuts 152 of the tape 150. The operation of the pie-shaped flaps formed by the cuts 162 is substantially the same as that of the T-cuts 152.

Figure 17:
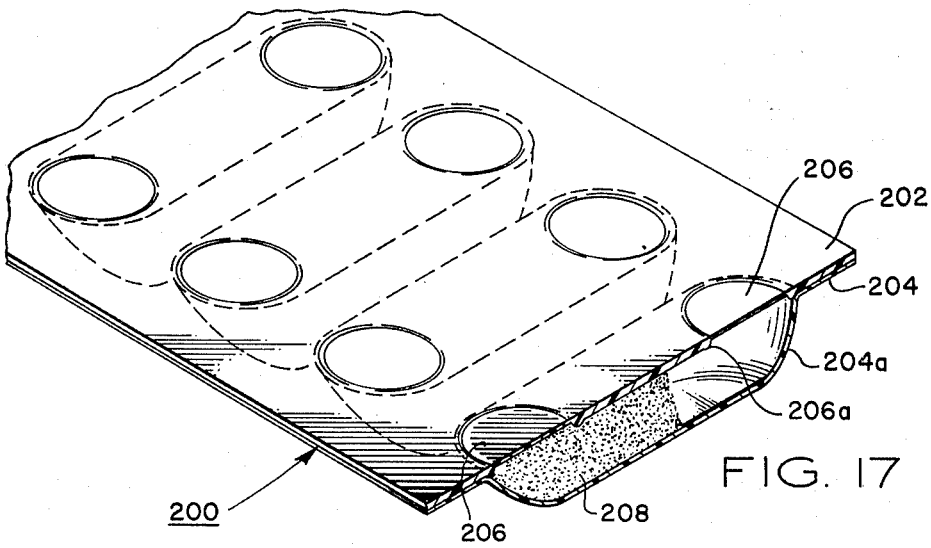
FIG. 17 is a perspective view, partially broken away, illustrating another encapsulating tape in accordance with the present invention.

Another encapsulating tape in accordance with the present invention is indicated generally by the reference numeral 200 in FIG. 17. The encapsulating tape 200 has a relatively thick film strip 202 which is flat, and a relatively thin film strip 204 which is indented to form a series of pockets 204*a* extending transversely of the tape. The two film strips are bonded around the pocket 204*a* to form discrete capsules each containing a particulate coating material. The relatively thick film strip 202 has embossed areas 206 at each end of each of the pockets 204*a* which are substantially thinner than the remainder of the film strip 202. The embossed areas 206 are formed by a hot die applied to the thick film strip 202 before the particulate material 208 is sealed in the capsules so that a thickened ridge 206*a* is formed around the periphery of the areas.

Figure 18:
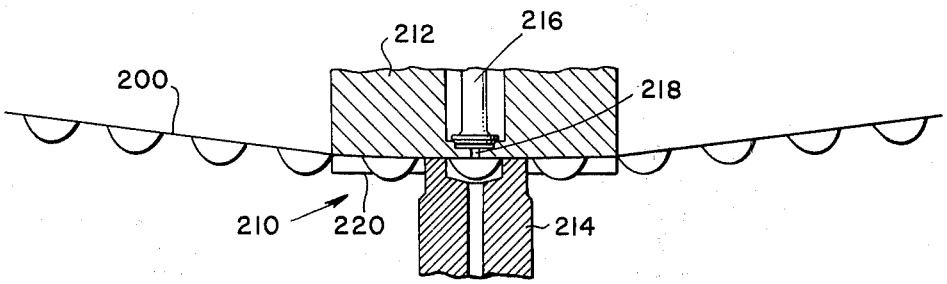
FIG. 18 is a sectional view similar to FIG. 7 illustrating another stripping station in accordance with the present invention for use with the encapsulating tape of FIG. 17.
Figure 19:
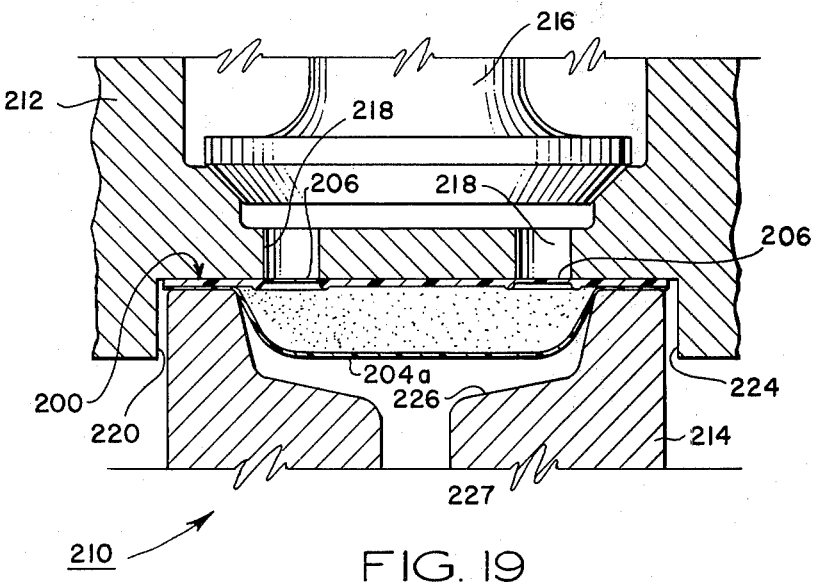
FIG. 19 is a sectional view taken at right angles to the sectional view of FIG. 18 and extending through the center of the stripping station.

The encapsulating tape 200 may be used in the stripping station indicated generally by the reference numeral 210 in FIG. 18. The stripping station 210 has an inlet manifold 212 and an outlet manifold 214. The inlet manifold 212, may be raised and lowered to the output mainfold 214, which may be stationary relative to the combustion chamber. The inlet header includes a valve 216, which controls the application of pneumatic pressure to a pair of ports 218 which are best illustrated in FIG. 19. The input manifold 212 may have side rails 220 and 224 to guide the tape 200. The cavity 226 formed in the outlet manifold 214 is sized somewhat larger than the pocket 204*a*.

Figure 20:
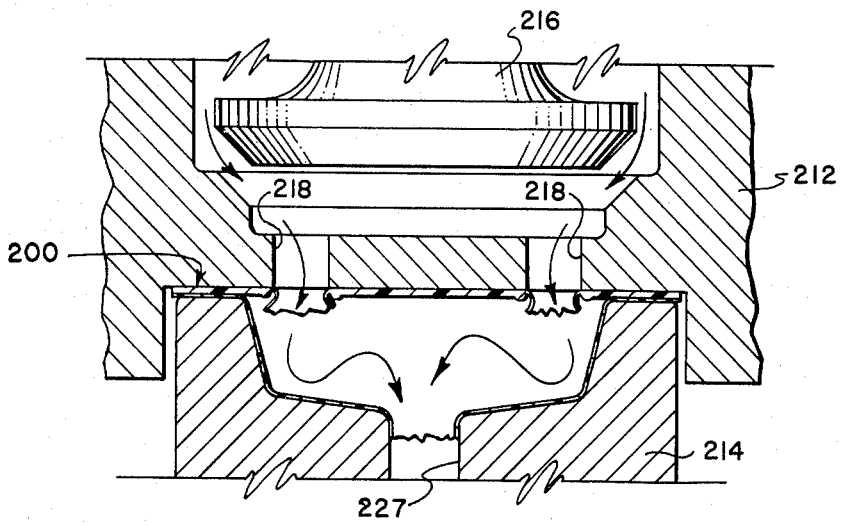
FIG. 20 is a view similar to FIG. 19 illustrating the operation of the stripping station of FIG. 18.

The operation of the stripping station 210 and the encapsulating tape 200 is illustrated in FIG. 20. The inlet manifold 212 is first lowered against the outlet manifold 214 to clamp the encapsulating tape 200 around the periphery of the capsule formed by pocket 204*a*. Then the valve 216 is opened to admit air through the ports 218. The high pressure, together with the impact of the high velocity air, causes the embossed areas 206 to rupture and admit air into the interior of the capsule. The air expands the relatively thin film forming the pocket 204*a* until the film ruptures over the outlet port 227. The particulate material is then swept out through the port 227 and injected into the combustion chamber as previously described. The indirect route the air must follow from inlet ports 218 to output port 227 causes considerable turbulence and complete scavenging of the particulate material from the interior of the chamber.

Figure 21:
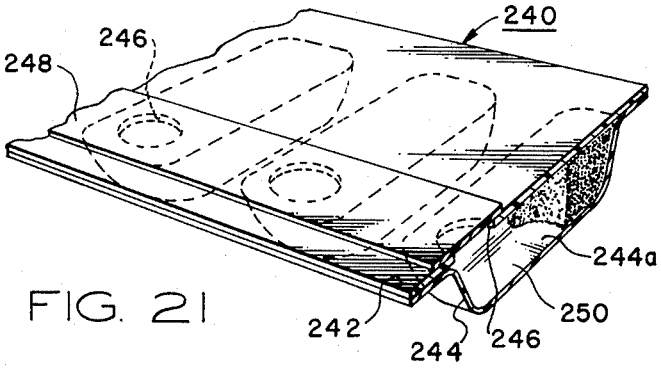
FIG. 21 is a perspective view, partially broken away, of still another encapsulating tape in accordance with the present invention.

Still another encapsulating tape in accordance with the present invention is indicated generally by the reference numeral 240 in FIG. 21. The encapsulating tape 240 includes a relatively thick film strip 242 and a thin strip 244 as heretofore described. The thin film strip 244 is indented to form pockets 244*a* which are elongated and extend transversely of the encapsulating tape as heretofore described in connection with the encapsulating tape 200. The relatively thick film strip 242 has a single aperature 246 cut over one end of each of the pockets 244*a*, and the aperatures 246 are sealed by a second thin film strip 248 bonded to the relatively thick film strip.

Figure 22:
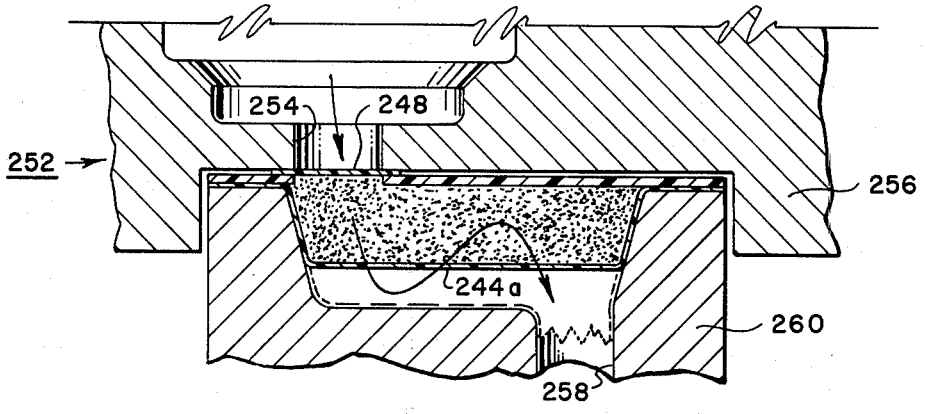
FIG. 22 is a sectional view similar to FIG. 8 illustrating a stripping station for use with the encapsulating tape of FIG. 21.

The particulate material 250 may be stripped from the encapsulating tape 240 using a stripping station indicated generally by the reference numeral 252 in FIG. 22. The stripping station 252 may be very similar to the stripping station 210 except that a single inlet port 254 is provided in the inlet manifold 256, and the outlet port 258 of the outlet manifold 260 is located at the opposite end of the stripping chamber. As a result, when high pressure air is applied to the film strip 248, the thin film breaks first admitting air into the interior of the capsule. The air pressure then expands the thin film forming pocket 244*a* until it bursts over the outlet port 258. The offset between the inlet and outlet ports results in longitudinal flow through the capsule and high turbulence within the stripping chamber, thus completely scavenging the particulate material from the capsule.

Anther stripping station in accordance with the present invention which may be used to strip particulate material from the encapsulating tape 50 is indicated 66 to form a capsule encapsulating a quantity of particulate material 72.

It is desirable that the material selected for the thin film strip 64 tear, but not fragment, when subjected to a sudden blast of very high pressure air to prevent pieces of the material from entering the combustion chamber. Polyethylene film on the order of 0.0005 inches thick may be used for this purpose. The thicker film 62 may also be polyethylene on the order of 0.004 inches thick. The total width of the encapsulating tape may be on the order of 0.375 inches and each pocket on the order of 0.280 inches long and 0.080 inches wide. Of course, the size and shape of the pockets may vary widely depending upon the amount of particulate material which is to be injected during each combustion cycle as will presently be described.

Figure 7:
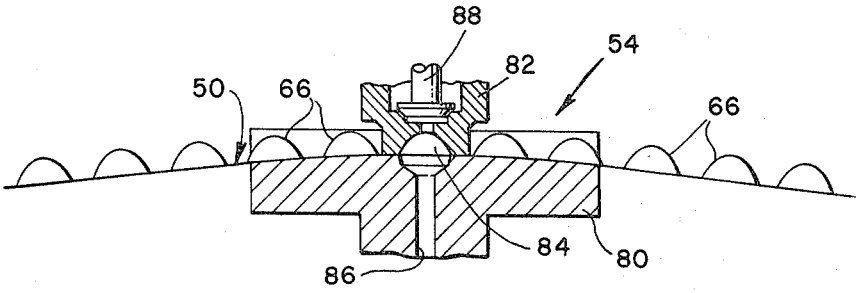
FIG. 7 is a simplified sectional view of the tape stripping station of the system of FIG. 1, with the sectional view taken through the center of the stripping station in a direction extending longitudinally of the encapsulating tape.

Referring now to FIG. 7, the stripping station 54 includes an output manifold 80 and an input manifold 82 which together form a pneumatic stripping chamber 84. The output manifold 80 has a short passageway 86 leading directly into the combustion chamber as can be seen in FIG. 1. The input header 82 may be raised to permit the successive capsules of the encapsulating tape 50 to be indexed into position in the stripping chamber, then lowered to clamp the tape around the periphery of the respective capsules as will presently be described. A valve 88 admits high pressure air from the compressed air source 22 to the stripping chamber 84. The injection port 86 is continually open to the combustion chamber.

Figure 8:
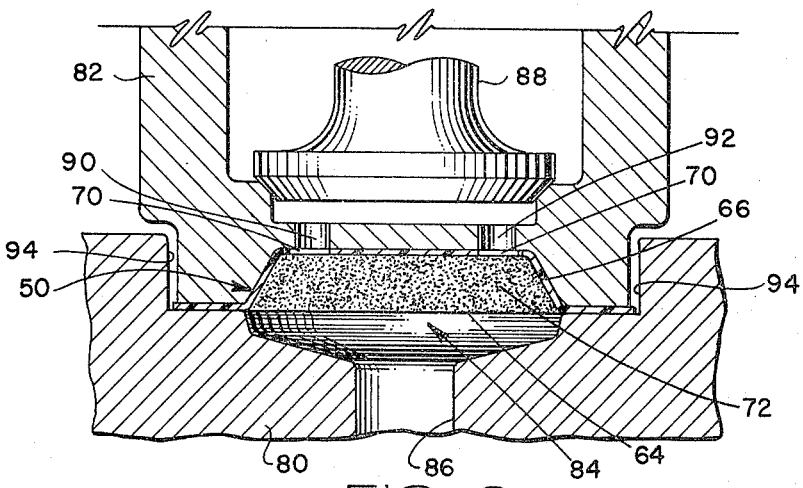
FIG. 8 is a sectional view extending through the center of the stripping station, and taken at right angles to the sectional view of FIG. 7.

The input manifold 82 has a cavity configured to closely receive each of the pockets 66 as illustrated in FIG. 8. The output header 80 has a cavity configured as illustrated in the sectional views of FIGS. 7 and 8 to permit expansion of the outlet face to provide free particle circulation within the expanded capsule, yet confine the expanding force sufficiently to cause it to rupture over the port 86. The input manifold 82 has a pair of orifices 90 and 92 disposed over the T-cuts 70 at the ends of the capsules. The output manifold 80 has a pair of opposite shoulders 94 to guide the encapsulating tape 50 as it is moved past the stripping station.

Figure 2:
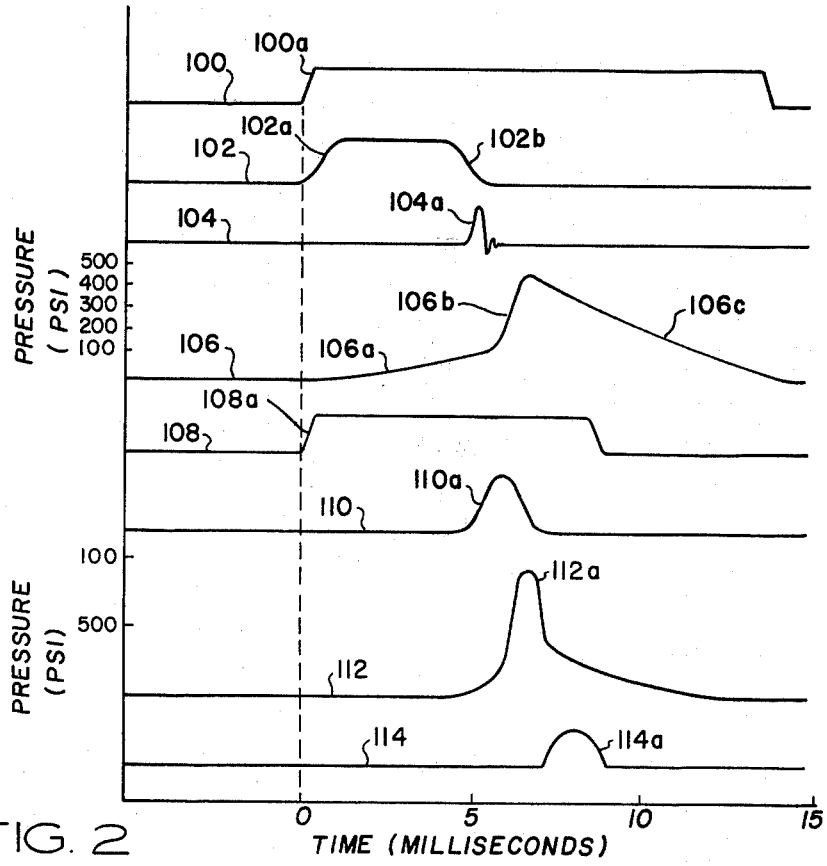
FIG. 2 is a timing diagram which serves to illustrate the operation of the system of FIG. 1.
Figure 3:
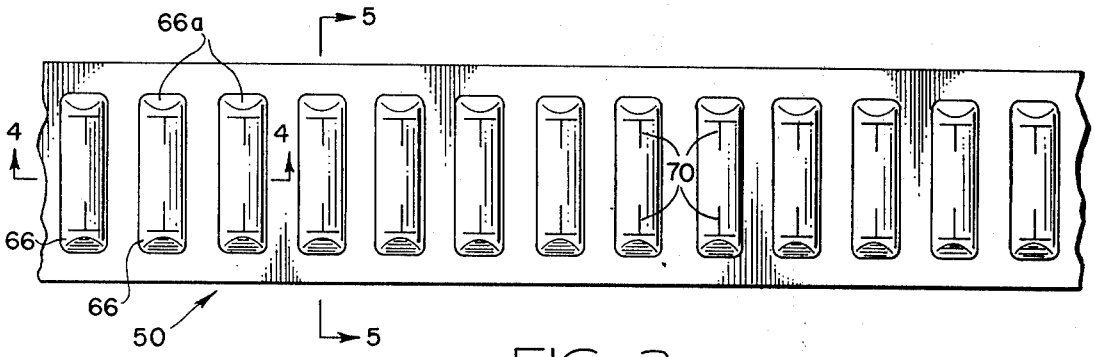
FIG. 3 is a plan view of an encapsulating tape in accordance with the present invention.

In the operation of the system 12, the leader from the encapsulating tape 50 is threaded through the sensor 52, through the stripping station 54 and over the idler roller 56 to the take-up reel 58. When it is desired to initiate coating, the take-up reel 58 is actuated to begin pulling the tape 50 through the stripping station 54 at a uniform rate. When the sensor 52 detects the presence of a capsule 66, the sequence of events illustrated in FIG. 2 is initiated. The event 100*a* on the top line 100 represents when a capsule 66 is approaching the stripping chamber. The inlet valve 19 begins to open as represented by event 102*a* on time line 102. As the valve 19 is closing at event 102*b*, the voltage is applied by the ignition system 26 to the spark plug 24 as represented by event 104*a* on time line 104. The combination of the valve 19 opening and the spark from the spark plug 24 results in a pressure within the chamber represented by line 106. The gradually sloping segment 106*a* represents the period while the pressure in the chamber rises due to the fuel-air mixture being input through the valve 19, the sharp rising segment 106*b* represents the pressure rise due to combustion of the mixture in the chamber, and the declining segment 106*c* represents the period during which the gases of combustion blow out through the nozzle 16.

At some time before application of the ignition voltage, the inlet manifold 82 is moved downwardly to clamp the encapsulating tape as represented by event 108*a* on time line 108. As soon as the tape has been clamped, the injection valve 88 is opened as represented by event 110*a* on time line 110. As a result, the very high pressure air, represented by event 112*a* on time line 112, jets through the orifices 90 and the pressure and impact deflects the flaps formed by the T-cuts 70, and the capsule is pressurized. This pressure streteches the thin film 64 downwardly against the lower face of the stripping chamber formed by the outlet manifold 80 and the thin film is stretched until it bursts over the outlet 86. The turbulent conditions of the air within the capsule very effectively and very instantly purge all of the particulate material from the capsule and pneumatically convey it out through the passageway 86. The coating period is represented by event 114*a* on time line 114.

As a result of the resistance of the arcuate pocket 66 to being collapsed by the pressure applied to the top, and because of the preferential entry of the pressure through the T-cuts into the interior of the capsule, the two films cannot be held together by the flow of air to trap particles between the films. The very low volume of the cavity between the valve 88 and the stripping chamber assures a very high response rate to the opening of the valve 88, so that the particulate material 72 is injected into the combustion chamber in a very short period of time. This assists in insuring that all of the particles are heated to the same extent and are propelled out of the combustion chamber at nearly the same velocity so as to provide a high coating efficiency and a coating of improved quality.

Figure 9:
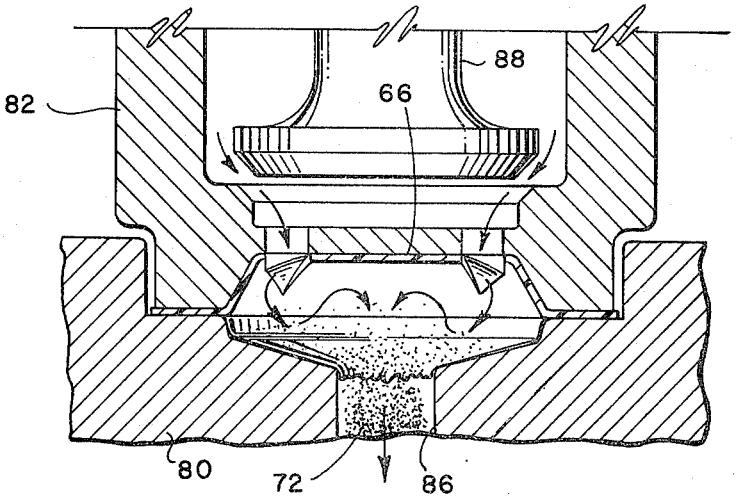
FIG. 9 is a sectional view similar to FIG. 8 illustrating the operation of the stripping station.
Figure 10:
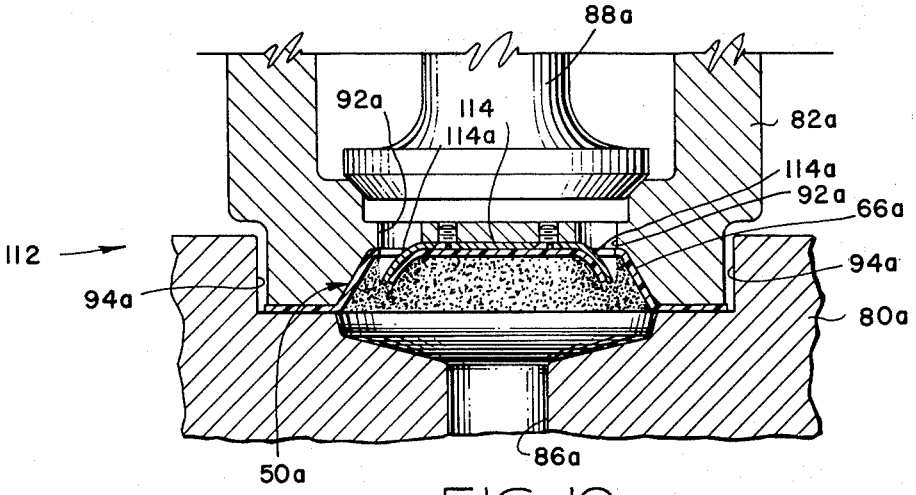
FIG. 10 is a sectional view similar to FIG. 8 showing another stripping station in accordance with the present invention.

An alternative embodiment of the stripping station is indicated generally by the reference numeral 112 in FIG. 10. The stripping station 112 may utilize an encapsulating tape 50*a* which may be identical to the encapsulating tape 50, except that the T-cuts 70 are eliminated. The station 112 may be substantially identical to the station 54 and, accordingly, corresponding components are designated by the same reference numerals followed by the reference character "a". The only significant difference in the station 100 from that of the station 54 is that a piercing device 114 is provided to mechanically puncture the ends of the capsules of the tape 50*a*, in lieu of the T-cuts. The piercing device 114 has a pair of downturned sharp prongs 114*a* which pierce the capsules 66*a* as the inlet header 82*a* is lowered to clamp the tape prior to opening the valve 88*a*. The archshaped configuration of the capsules and the particulate material provides sufficient resistance to crushing to permit the prongs 114*a* to penetrate the relatively thick film. This structure permits the high pressure air to gain access to the interior of the capsule without crushing the upper film so that the particulate material is scavenged from the interior of the pocket as previously described in connection with FIG. 9.

Figure 11:
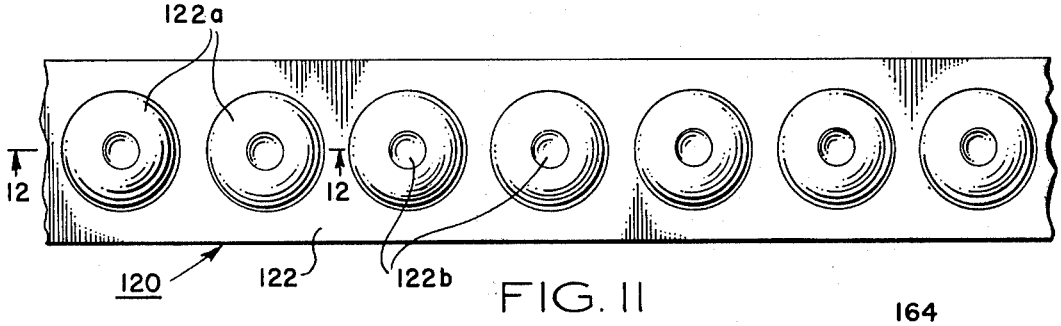
FIG. 11 is a plan view of another encapsulating tape in accordance with the present invention.
Figure 12:
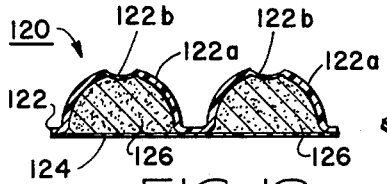
FIG. 12 is a sectional view taken substantially on lines 12—12 of FIG. 11.
Figure 23:
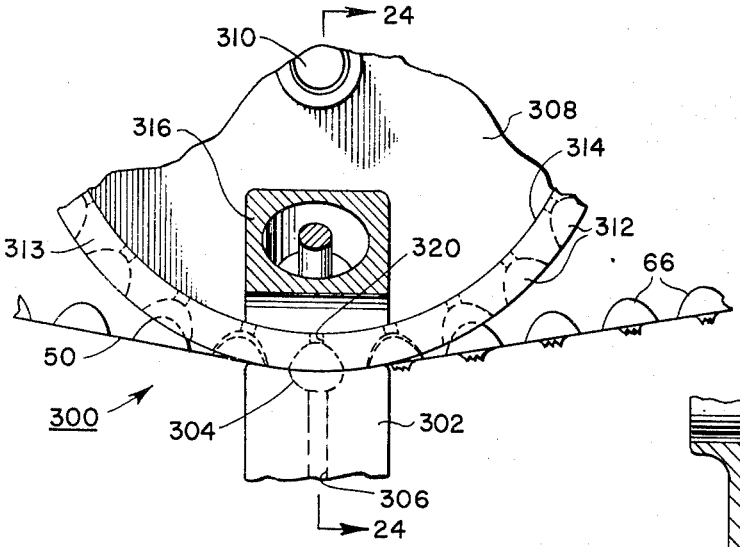
FIG. 23 is a simplified side view, partially in section of another stripping station in accordance with the present invention.
Figure 24:
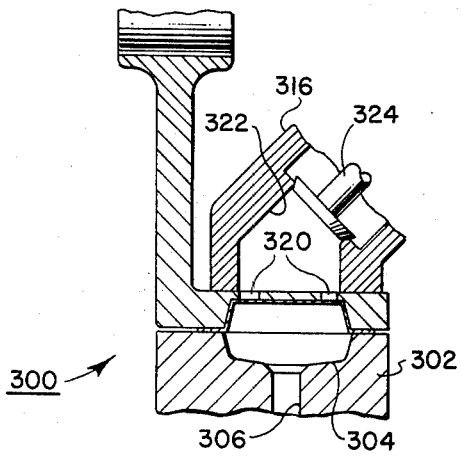
FIG. 24 is a sectional view taken substantially on lines 24—24 of FIG. 23.

Another encapsulating tape in accordance with the present invention is indicated generally by the reference numeral 120 in FIGS. 11 and 12. The encapsulating tape 120 is formed by a relatively thick film strip 122 which is embossed to provide a series of dome-shaped pockets 122*a* and a relatively thin film 124 which seals a measured quantity of particulate material 126 in each of the dome-shaped pockets. The top of each dome-shaped pocket 122*a* is dimpled to provide a very thin section 122*b* which will yield and be perfogenerally by the reference numeral 300 in FIGS. 23 and 24. The stripping station 300 includes an output manifold 302 having a cavity 304 which communicates with an outlet port 306 leading to the combustion chamber. A turret 308 is journaled on an axle 310 and has an outer surface which comes in close proximity to the end of the outlet manifold 302. A plurality of inlet manifold cavities 312 are formed in the outer surface of the rim 313 of the turret 308 and are spaced to receive the successive capsules 66 of the tape 50. The inside surface 314 of the rim 313 provides a cylindrical sealing surface which mates with an inlet header assembly 316 to provide a sliding seal. Each of the cavities 312 communicate with the sealing surface 314 through a pair of ports 320 which are best seen in FIG. 24. The header assembly 316 has a port 322 which registers with the pair of ports 320 disposed at the stripping station and communicates through a valve 324 to the high pressure pneumatic source. The entire turret 308 and input header assembly 316 may be moved toward the output mandril 302 to clamp the tape and effect a peripheral seal or the peripheral seal may be provided by the tape being wedged between the outer surface of the rim 313 and the output manifold assembly 302. In operation, the turret 308 preferably rotates at a constant speed with the combustion cycle initiated at the appropriate time by the control system so that the capsule 66 will be positioned over the stripping cavity 304 at the instant when the powder is to be injected into the combustion chamber. The valve 324 is then merely opened and the high pressure gases pass through the ports 320 and through the capsule as previously described in connection with FIG. 9.

Figure 28:
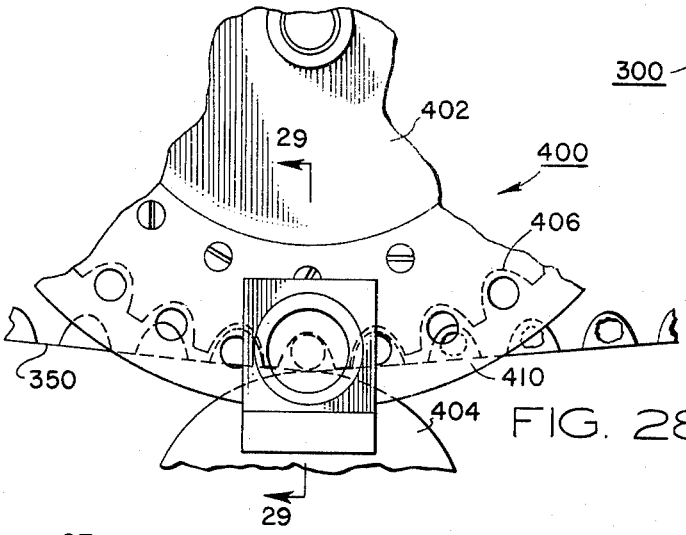
FIG. 28 is a simplified plan view illustrating a stripping station designed to utilize the encapsulating tape of FIG. 25.
Figure 25:
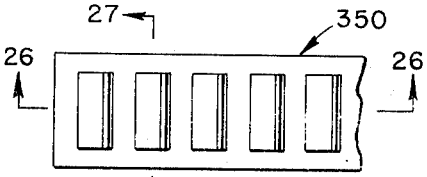
FIG. 25 is a plan view of another encapsulating tape in accordance with the present invention.
Figure 26:
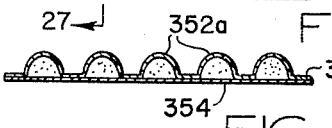
FIG. 26 is a sectional view taken substantially on lines 26—26 of FIG. 25.
Figure 29:
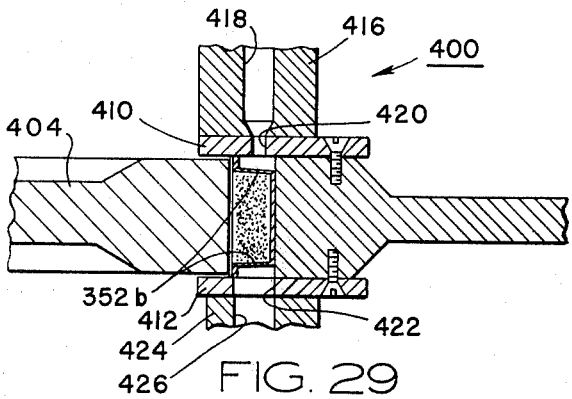
FIG. 29 is a sectional view taken substantially on lines 29—29 of FIG. 28.
Figure 27:
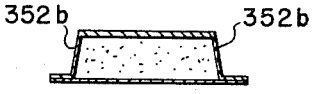
FIG. 27 is a sectional view taken substantially on lines 27—27 of FIG. 25.

Another encapsulating tape in accordance with the present invention is indicated generally by the reference numeral 350 in FIG. 25. The tape 350 is comprised of a pair of film strips 352 and 354 which may be heat welded together. The flat film strip 354 may be of about the same thickness as film strip 354. The film strip 352 has a series of deep draw pockets 352*a* having a generally rectangular configuration extending transversely of the tape as illustrated in FIG. 25, and an arcuate cross-section as illustrated in FIG. 26. The end surfaces 352*b* are disposed at near right angles to the plane of the tape 350 so that the deep draw pockets cause the end surfaces to be relatively thin compared to the portion of the pocket forming the arch. The end surfaces thus become preferential pneumatic fail points when the tape is used in the stripping station indicated generally by the reference numeral 400 in FIGS. 28 and 29.

In the stripping station 400, the tape 350 is passed between a rotary turret 402 and a rotary back-up wheel 404. The rim of the turret 402 is provided with a plurality of cavities 406 sized and spaced to closely receive the capsules 352*a* of the tape 350. The back-up wheel 404 may be spring biased toward the rim of the turret 402 to clamp the web of the tape 350 and form a peripheral seal around each capsule. A pair of valve plates 410 and 412 are mounted on opposite edges of the rim of the turret 402. An inlet header 416 has a port 418 which communicates with the high pressure air source. The valve plate 410 has a port 420 associated with each of the cavities 406. Similarly, the valve plate 412 has an outlet port 422 which communicates with each of the cavities 406. The outlet manifold 424 has a port 426 which communicates directly with the combustion chamber.

In operation, the turret 402 and the back-up wheel 404 are rotated at a uniform speed. The combustion cycle of the system is initiated at the proper point of travel of the turret 402 so that the port 420 will be aligned with the port 418 at the instant when it is desired to inject the powder into the combustion chamber. Thus, as each successive port 420 registers with the port 418, high pressure air is valved into the sealed chamber formed by the turret 402 and the back-up wheel 404. The high pressure on the weakened end faces 352*b* of the capsule burst as a result of the pressure and the powder is blown through the port 425 and injected in the combustion chamber.

From the above detailed description of preferred embodiments of the invention, it will be appreciated by those skilled in the art that a system has been described wherein particulate material can be injected into a high pressure combustion chamber of a combustion-type coating system over a very short interval of time initiated at the precise instant required to optimize coating efficiency. Additionally, the system promotes complete scavenging of the capsule without entraining the material forming the capsule in the pneumatic stream for injection into the combustion chamber, thus assuring that the encapsulating material will not interfere with the quality of the coat being applied to the work piece. Where desired, the particulate material may be encapsulated in a moisture-proof encapsulating tape at the material manufacturing plant to protect the particulate material from moisture and oxidation. The encapsulation also prevents segregation of the different sizes of particulate material, and further insures an even and controlled feed of the particulate material to enhance the control which can be exercised in maintaining a uniform coating thickness.

Although preferred embodiments of the invention have been described in detail, it is to be understood that various changes, substitutions and alterations can be made therein without departing from the spirit and scope of the invention as defined by the appended claims.

What is claimed is:

1. The method for repeatedly injecting measured quantities of particulate material into a chamber which comprises:

encapsulating a measured quantity of particulate material in a plurality of capsules each of a given volume formed of thin film material having a sealed periphery, a pneumatic inlet face and a pneumatic outlet face, the capsules forming a continuous tape, successively positioning the capsules in a pneumatic stripping chamber with the outlet face adjacent an outlet port communicating with the chamber, clamping the tape around the periphery of each capsule as the capsule is positioned within the stripping chamber, injecting a greater volume of gas than said given volume and at a higher pressure than the pressure in the chamber into the interior of the capsule, bursting the outlet face by said pressure, pneumatically stripping the particulate material from the capsule, and directing the gas and particulate material issuing from the outlet face into the chamber.

2. The method of claim 1 wherein the gas is injected into the capsule by pneumatically rupturing an inlet face of the capsule.

3. The method for repeatedly injecting measured quantities of particulate material into a chamber which comprises:

encapsulating a measured quantity of particulate material in a plurality of capsules each of a given volume formed of thin film material having pneumatic outlet face, the capsules forming a continuous tape, successively positioning the capsules in a pneumatic stripping chamber with the outlet face adjacent an outlet port communicating with the chamber, injecting a greater volume of gas than said given volume and at a higher pressure than the pressure in the chamber into the interior of the capsule by first mechanically penetrating an inlet face of the capsule, bursting the outlet face by said pressure, pneumatically stripping the particulate material from the capsule, and directing the gas and particulate material issuing from the outlet face into the chamber.

4. The method for repeatedly injecting measured quantities of particulate material into a chamber which comprises:

encapsulating a measured quantity of particulate material in a plurality of capsules each of a given volume formed of thin film material having a pneumatic inlet face and pneumatic outlet face, the capsules forming a continuous tape, successively positioning the capsules in a pneumatic stripping chamber with the outlet face adjacent an outlet port communicating with the chamber, injecting a greater volume of gas than said given volume and at a high pressure than the pressure in the chamber into the interior of the capaule, bursting the outlet face by said pressure, pneumatically stripping the particulate material from the capsule, wherein the gas is injected into the capsule such that the gas must traverse a curved path through the capsule to exit through the outlet port to cause turbulent scavengering of the particulate material from the capsule, and directing the gas and particulate material issuing from the outlet face into the chamber.

* * * * *

UNITED STATES PATENT AND TRADEMARK OFFICE

CERTIFICATE OF CORRECTION

PATENT NO. : 3,974,939

DATED : August 17, 1976

INVENTOR(S) : Rosser B. Melton, Jr., Elbert M. Hubbard

It is certified that error appears in the above-identified patent and that said Letters Patent are hereby corrected as shown below:

Col. 2, line 5, "undersidable" should be -- undesirable --.

Col. 2, line 35, "inventiion" should be --invention--.

Col. 2, line 42, "eat" should be -- heat --.

Col. 4, line 43, "greateer" should be -- greater --.

Col. 8, line 12, "pneuam-" should be -- pneuma- --.

Col. 12, line 13, Claim 4, "high" should be -- higher --.

Signed and Sealed this

Fourth Day of January 1977

[SEAL]

*Attest:*

RUTH C. MASON
*Attesting Officer*

C. MARSHALL DANN
*Commissioner of Patents and Trademarks*